US008170261B2

(12) United States Patent
Danielson et al.

(10) Patent No.: US 8,170,261 B2
(45) Date of Patent: May 1, 2012

(54) PERSONAL AUDIO SET WITH ADJUSTABLE FORCE MECHANISMS

(75) Inventors: Alexander S. Danielson, Vancouver, WA (US); Jason Lin, Washougal, WA (US); Neil O'Connell, Portland, OR (US)

(73) Assignee: Logitech Europe S.A., Morges (CH)

( * ) Notice: Subject to any disclaimer, the term of this patent is extended or adjusted under 35 U.S.C. 154(b) by 444 days.

(21) Appl. No.: 12/436,733

(22) Filed: May 6, 2009

(65) Prior Publication Data

US 2010/0189303 A1 Jul. 29, 2010

Related U.S. Application Data

(63) Continuation-in-part of application No. 12/034,530, filed on Feb. 20, 2008.

(51) Int. Cl.
*H04R 25/00* (2006.01)

(52) U.S. Cl. ..... 381/374; 381/377

(58) Field of Classification Search ..... 381/374, 381/377, 370, 376, 378
See application file for complete search history.

(56) References Cited

U.S. PATENT DOCUMENTS 5,794,911 A 8/1998 Hill
6,260,197 B1 * 7/2001 Hoogewind ..... 2/8.3
6,298,249 B1 10/2001 Locarno et al.
6,993,143 B2 * 1/2006 Harris et al. ..... 381/379
7,168,098 B2 * 1/2007 West ..... 2/93
7,412,070 B2 * 8/2008 Kleinschmidt et al. ..... 381/374
2001/0005339 A1 * 6/2001 Hara et al. ..... 368/208
2002/0171277 A1 11/2002 Bock
2005/0022806 A1 * 2/2005 Beaumont et al. ..... 128/200.14
2006/0015986 A1 * 1/2006 Bielefeld ..... 2/181
2006/0212998 A1 9/2006 Gath
2006/0237885 A1 * 10/2006 Paillard et al. ..... 248/550
2008/0101642 A1 * 5/2008 Senda ..... 381/370
2008/0175406 A1 * 7/2008 Smith ..... 381/87
2008/0214999 A1 * 9/2008 Kletchka et al. ..... 604/96.01

* cited by examiner

*Primary Examiner* — Brian Ensey
(74) *Attorney, Agent, or Firm* — Kilpatrick Townsend & Stockton LLP

(57) ABSTRACT

A personal audio device including a flexible headband is disclosed. The flexible headband includes a left and right headband portion. The headband has a longitudinal centerline which occupies a substantially single plane. The personal audio device also includes a left earphone, which is secured to a first end of the left headband portion, and a right earphone, which is secured to a first end of the right headband portion. A connector portion connects a second end of the left headband portion with a second end of the right headband portion. The connector portion is linearly adjustable, which enables a distance between the left headband portion and right headband portion to be variable. A change in the distance causes an inversely proportional change in bent compression force applied by a left earphone and applied by the right earphone.

31 Claims, 9 Drawing Sheets

PERSONAL AUDIO SET WITH ADJUSTABLE FORCE MECHANISMS

This application is a continuation-in-part of application Ser. No. 12/034,530, filed Feb. 20, 2008.

BACKGROUND OF THE INVENTION

1. Field of the Invention

This invention relates generally to personal audio sets, and more particularly to a personal audio set with adjustable force mechanisms.

2. Description of the Related Art

Personal audio sets, commonly known as headphones, earphones, headsets, and the like, are gaining in popularity. The typical personal audio set includes a frame containing an earphone that is usually positioned over, on, or inside a wearer's ear. In cases where the audio set is a headset, a microphone is also typically positioned near the wearer's mouth.

Earphones for use with various kinds of audio sets for plugging into MP3 players, video game consoles, and different kinds of communication equipment have been in general use heretofore. Usually, a pair of earphones are attached to opposite ends of a bendable plastic or metal band that is worn over the head of the user such that the earphones are engaged with the ears of the user. These types of mounting structures are known as "over-the-head" mounts. Sets of this type have the disadvantage of being cumbersome to maintain in good aural connection with the wearer's ear and relatively uncomfortable to wear for extended periods of time.

For example, typical over-the-head mounts have earphones connected to a headband that is formed substantially into a C-shape with a predetermined curvature so that the width between both ends thereof is narrower than the average head width of the ordinary adult user. When the earphones are used, the user opens out the headband in the right and left direction and wears the earphone units by holding them to the wearer's ears. When the earphones are worn, the headband is curvedly deformed so that the radius of curvature thereof increases, by which a bent compression force (restoring force) is generated in the headband in the direction such that the initial radius of curvature is restored. In essence, the bent compression force is exerted in a direction such that the radius of curvature decreases.

This bent compression force of the headband is determined by the difference between the initial radius of curvature and the radius of curvature at the time when the headphones are worn. Moreover, the physical properties such as shape and material of the headband are considered. Therefore, the headband is designed so as to give a good sense of wearing to the user having the average head width. However, the width of the human head varies considerably. When a user with a narrower-than-average head uses the typical headphone, the bent compression force is weaker than the force encountered by a user with a normal sized head. Likewise, a user with a wider-than-average head will experience a bent compression force that is stronger than the force encountered by the user with the normal sized head.

Over-the-head headphones with adjustable lengths permit self adjustment of the headband in order to accommodate a wearer's head size and other parameters. Often times the expansion mechanism allows the length of the headband to accommodate heads of various sizes, but produces the side-effect of reducing the initial radius of the curvature of the headband, producing a tight radius of curvature. This reduced radius causes an increase in the bent compression force as the length of the C-shaped headband is increased. More specifically, as the headband is lengthened, the length-adjustment system creates excessive force on the scull and ears, especially, if the wearer's head is bigger than the average. As the headband is shortened to accommodate smaller sized heads, the pressure is lessened, causing poor aural connection with the wearer's ear. Although this type of length-adjustment provides a quick way of adjusting for the size of the wearer's head, there is no satisfactory way of specifically tuning the force or pressure applied to the wearer's head and/or ears. Without being able to perform such tuning, the audio set may become uncomfortable to use.

Another method for detachably securing a personal audio set to a wearer includes securing the personal audio set to a headband that encircles the rear portion of the wearer's head. These types of mounting structures are commonly known as "behind-the-head" mounts. Known behind-the-head mounts have several drawbacks. For example, many are not sizeably adjustable, causing the headband to rest on a potentially uncomfortable position on the back of the wearer's neck. Moreover, like the over-the-head mounts, the pressure or force applied by the audio set onto the earphone and the wearer's ear is also not adjustable, making the device uncomfortable to wear for long periods of time when the force is too tight, and causing poor aural connection with the wearer's ear when the force is too weak.

Headphones, such as that described in Furuya et al. (U.S. Pub. No. 2007/0165900), provide for the adjustment of the length of the headband (to accommodate different sized heads) and simultaneous maintenance of a constant pressure to the user's ear, regardless of the size or shape of the user's head. However, there is no way to adjust the pressure levels, for example, according to the user's preferences over time. After long time use, a user's ears may become more sensitive to the uniform pressure setting.

Other headphones include a headband with dual pivots, such as that described in Pelt et al. (U.S. Pat. No. 4,404,434), which enable the headphone to be folded-in for ease of transportation when not in use. The pivotal connection on these types of headphones only permit changing from a single operating position to a transport position. Thus, the pressure or force felt by a user in the operating position is not adjustable.

BRIEF SUMMARY OF THE INVENTION

Embodiments of the present invention address the foregoing and other such problems by providing a personal audio set mechanism by which a wearer can control the bent compression force of a headband.

In one set of embodiments, a personal audio device includes a flexible headband. The flexible headband includes a left and right headband portion. In one embodiment, the headband has a longitudinal centerline and occupies a substantially single plane. The personal audio device also includes a left earphone, which is secured to one end of the left headband portion, and a right earphone, which is secured to one end of the right headband portion. A connector portion connects the other end of the left headband portion with the other end of the right headband portion. The connector portion is linearly adjustable, which enables a distance between the left headband portion and right headband portion to be variable. A change in the distance causes an inversely proportional change in bent compression force applied by a left earphone and applied by the right earphone. In another embodiment, the headband is of fixed length and the connector portion is adjustable, which also enables a distance between the left headband portion and right headband portion to be variable.

In one embodiment, the connector portion has a sliding system, allowing a blade to slide out of a frame of the headband to extend its width. The blade is held in the extended position by a combination of friction and detents. A slight curve is provided, with the radius of the curve varying between about 223 mm in the closed position to 193 mm in the open position. In one embodiment, the radius of the curve is at least 140 mm to insure minimal variation in force.

In another set of embodiments, the personal audio device includes a flexible headband which is formed to fit over the head of a user. The headband has a pair of ends. In one embodiment, the personal audio device includes two pivot mechanisms. A first pivot mechanism can pivotally attach a first earphone assembly to one end of said headband. This enables pivoted motion between an initial operating position and one or more adjustable operating positions. The second pivot mechanism can pivotally attach a second earphone assembly to the other end of said headband for pivotal motion between the initial operating position and the one or more adjustable operating positions. By pivoting at least one of the first earphone and the second earphone, the bent compression force that is applied by the pivoted one of the first earphone and the second earphone is changed.

In yet another set of embodiments, the personal audio device may enable the bent compression force to be changed using a single pivot mechanism. In one embodiment, a flexible headband includes a left headband portion and a right headband portion. A left earphone is secured to a first end of the left headband portion and a right earphone is secured to a first end of the right headband portion. A pivot mechanism can connect the second end of the left headband portion with a second end of the right headband portion. The pivot mechanism enables pivoted motion of at least one of the left headband portion and the right headband portion between an initial operating position and one or more adjustable operating positions. Pivoting at least one of the left headband portion and the right headband portion causes a change in the bent compression force that is applied by the pivoted headband portion.

One advantage of the embodiments is that the audio set described herein provides more targeted control of the amount of compressive force applied to the user's ears by the earphones. Thus, audio sets are no longer limited to being optimal for the design value keyed to the "normal" sized head.

Another advantage is that user experience is made more consistent for user's of various sizes and shapes. In effect, a user with a small-sized head and a user with a large-sized head can experience the same amount of bent compression force by the earphones. For all types of users, the earphones can be sufficiently pressed onto the wearer's ear (limiting sound leakage) without causing physical pain from long term usage.

Yet another advantage is that a user may adjust the amount of bent compression force that is applied based on preference over time. This enables the user to manually adjust the amount of compression force, for example, due to increased sensitivity to pressure through extended use. Thus, using a single production model, various users can effectively tailor the audio set according to their own physical characteristics and changing preferences.

A further understanding of the nature and the advantages of the embodiments disclosed herein may be realized by reference to the remaining portions of the specification and the attached drawings.

BRIEF DESCRIPTION OF THE DRAWINGS

The invention may best be understood by reference to the following description taken in conjunction with the accompanying drawings in which.

DETAILED DESCRIPTION OF THE INVENTION

In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown.

Current versions of personal audio sets do not provide a mechanism targeted for adjustment of bent compression force or pressure onto a wearer's ear. Embodiments of the present invention overcome this and other problems and facilitate an adjustable force mechanism for a personal audio set.

In the description that follows, embodiments will be described in reference to audio sets such as headphones. However, embodiments are not limited to any particular environment or implementation. For example, although embodiments will be described in reference to behind-the-head and over-the-head headphones, aspects of the invention may be advantageously applied to other types of personal audio sets. Therefore, the description of the embodiments that follows is for purposes of illustration and not limitation.

Figure 1:
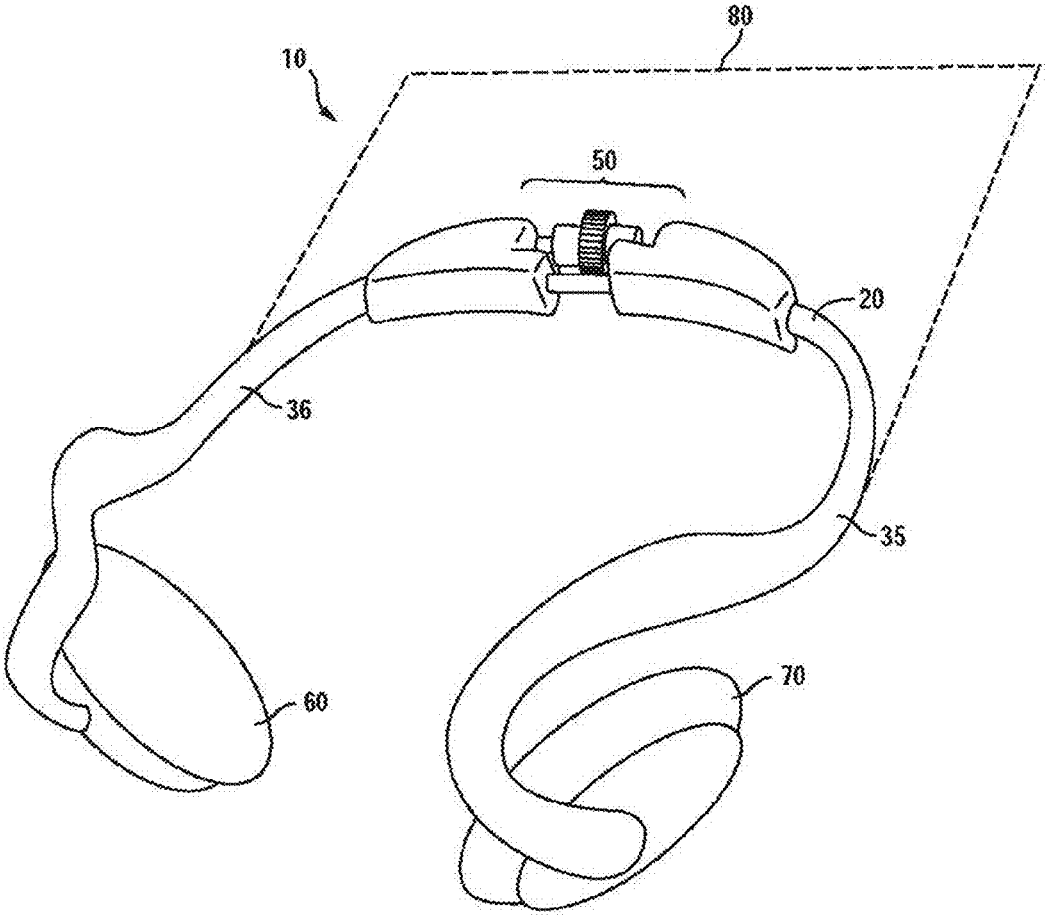
FIG. 1 illustrates a front, left, perspective view of a behind-the-head mounted personal audio set with a linear adjustable force mechanism in accordance with an embodiment of the present invention.

Embodiments of the present invention provide a personal audio set with adjustable force mechanisms, which enable a wearer to adjust the force applied by an earphone of the personal audio set. A behind-the-head mounted personal audio set 10 is shown in FIGS. 1-2(B). FIG. 1 illustrates a front, left, perspective view of a behind-the-head mounted personal audio set with a linear adjustable force mechanism in accordance with an embodiment of the present invention. In a preferred embodiment, the behind-the-head mounted personal audio set 10 has a curved headband 20 formed into an arc, preferably occupying a common plane 80. The headband 20 has a first portion 35 and a second portion 36. The headband 20 also includes a connector portion 50 which connects the first portion 35 through a first end of the connector portion 50 with the second portion 36 through a second end of the connector portion 50. Together with the first portion 35 of the headband and the second portion 36 of the headband, the connector portion 50 makes up the headband 20 assembly. The headband 20 is preferably sized to encircle and slightly grasp the rear contour of a wearer's head substantially between the wearer's ears. Adjustment of the connector portion 50 enables the wearer to modify a bent compression force or pressure applied onto the wearer's ears by the left and right earphones 70 and 60, respectfully.

In one embodiment, the connector portion 50 includes an adjustable mechanism by which a distance between the first portion 35 and the second portion 36 is increased or decreased. Increased separation produces a decrease in compressive force applied to the ears of the wearer by the earphones 70 and 60. Likewise, a decrease in the separation distance produces an increase in compressive force. Thus, the compressive force applied to the ears of the wearer is inversely proportional to the distance between the first portion 35 and the second portion 36. The connector portion 50 is designed such that a uniform bent compression force can be applied by the earphones 70 and 60 for a wide range of sizes of a wearer's head. Specifically, the connector portion can be adjusted to exert a same force for users of various sizes and shapes.

Figure 2A:
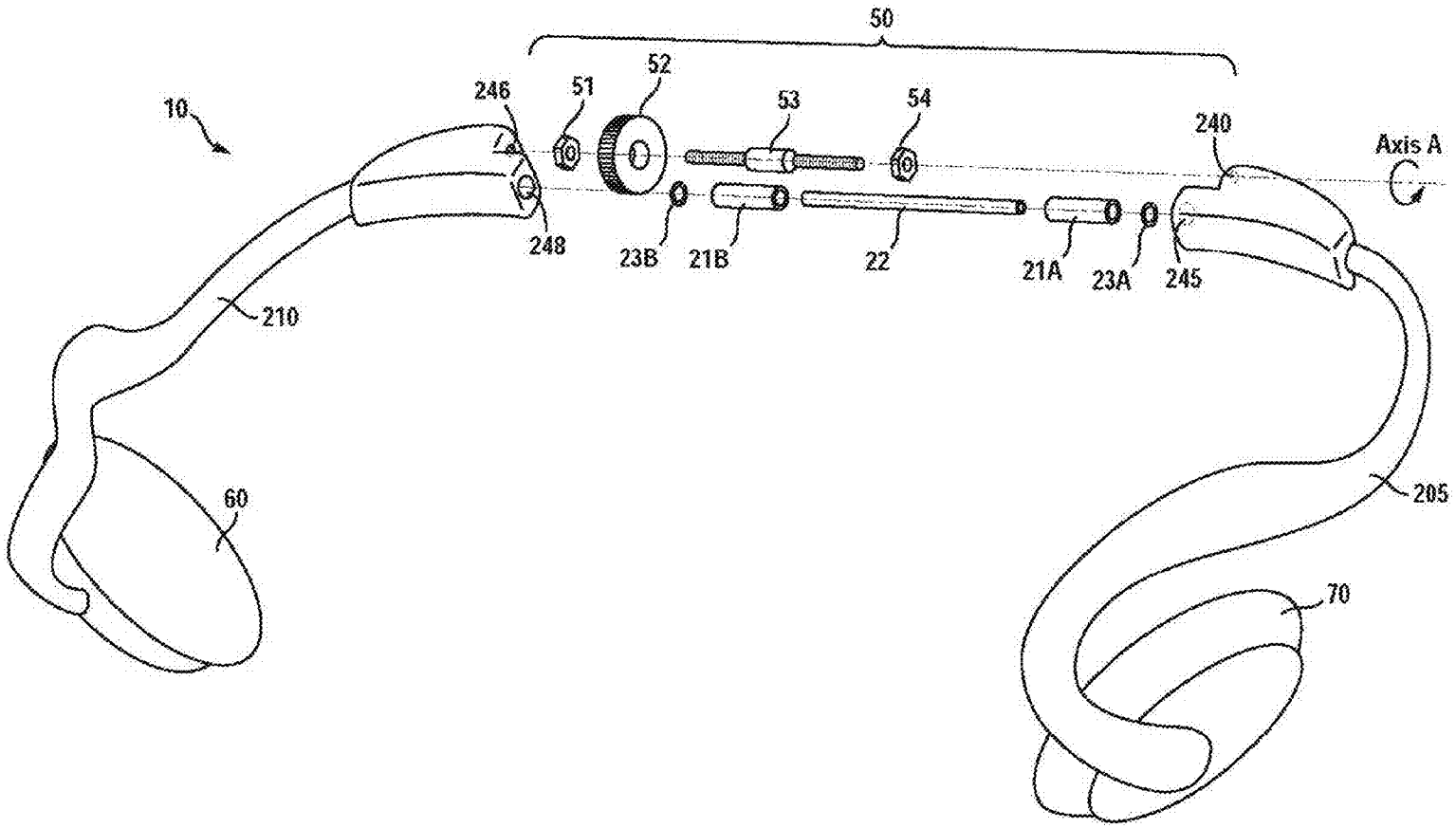
FIG. 2(A) illustrates a front, left, top exploded view of the behind-the-head mounted personal audio set of FIG. 1 in accordance with an embodiment of the present invention.
Figure 2B:
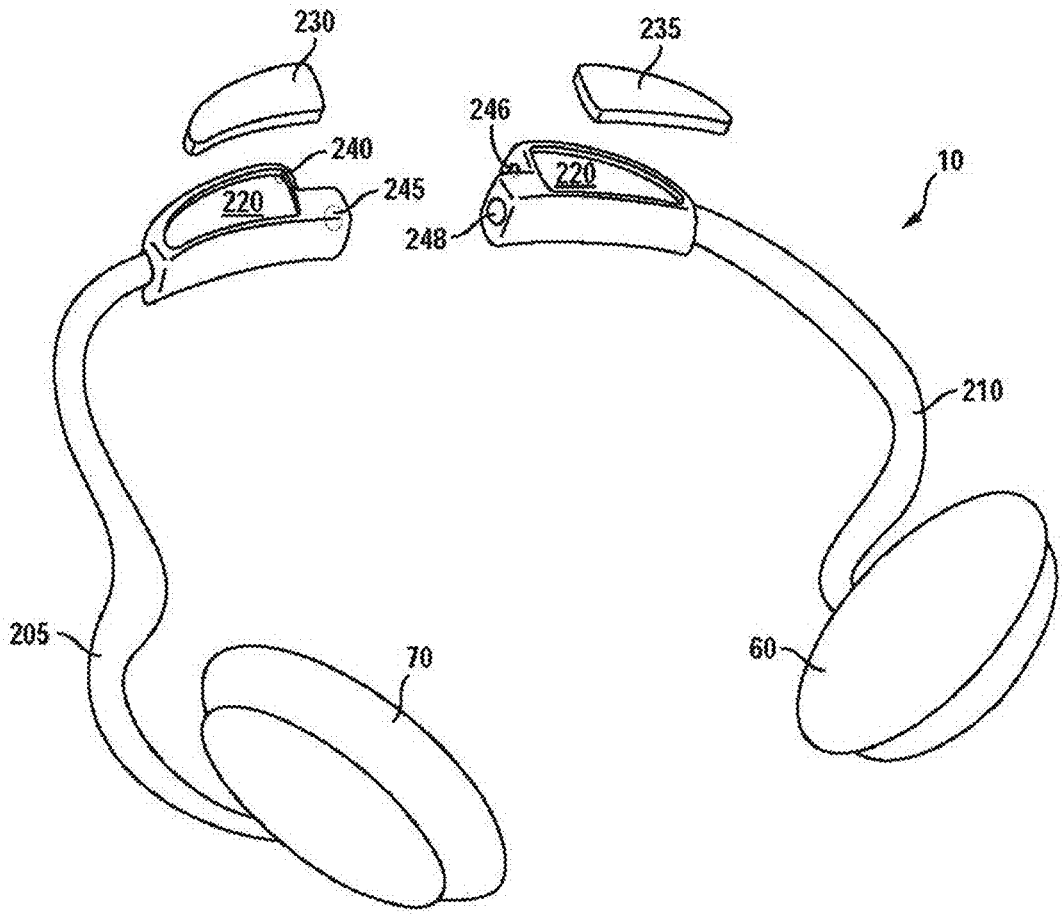
FIG. 2(B) illustrates a front, right, bottom exploded view of the behind-the-head mounted personal audio set of FIG. 1 in accordance with an embodiment of the present invention.

FIG. 2(A) illustrates a front, left, top exploded view of the behind-the-head mounted personal audio set 10 of FIG. 1 in accordance with an embodiment of the present invention. In one embodiment, the personal audio set is a headphone comprising a left portion 205 (first portion 35) of the head band 20 and a right portion 210 (second portion 36) of the headband 20. The left 205 and right 210 portions of the headband each include a first end and a second end. The first end of each of the left 205 and right 210 portions are secured to earphones 70 and 60, respectfully. The second end of the left 205 portion of the headband includes two detents 240 and 245. Similarly, the second end of the right 210 portion of the headband includes two detents 246 and 248. Detents 246 and 240 are aligned in a line on the common plane 80 and detents 248 and 245 also aligned on the common plane 80 in a different, but parallel line.

As will be explained, the left portion 205 is connected to the right portion 210 through the connector 50. A thread rod 53 is fitted with a scroll wheel 52 such that rotation of the scroll wheel 52 produces rotation of the thread rod 53 in the same direction as the rotational movement of the scroll wheel 52. A right hand thread anchor 51 is fitted onto a right end of the thread rod 53 and a left hand thread anchor 54 is fitted onto the opposing left end of the thread rod 53. Detent 246 is engaged by the right end of the thread rod 53 and detent 240 is engaged by the left end of the thread rod 53. Sliding hollow rod 22 is inserted within a left sleeve 21(A) and a right sleeve 21(B). Detent 245 is fitted with retarding ring 23(A) and is engaged by a left end of the sliding hollow rod 22. Detent 248 is fitted with retarding ring 23(B) and is engaged by a right end of the sliding hollow rod 22.

In order to adjust the bent compression force felt by a wearer of the personal audio set 10, the scroll wheel 52 can be manually rotated in a back or forth position. The rotation of the scroll wheel 52 causes the simultaneous rotation of the thread rod 53, which, in turn, causes the thread rod 53 to move in a longitudinal manner through the right hand thread anchor 51 and the left hand thread anchor 54. In essence, the rotation of the scroll wheel 52 causes linear expansion or contraction of the headphone assembly within the common plane 80 of the audio set 10. The linear movement (i.e., expansion or contraction) occurs along the rotational axis of the scroll wheel 52 (hereinafter, "axis A"). The sliding hollow rod 22 linearly expands or contracts along the sleeves 21(A) and 21(B) within the common plane 80 of the audio set 10. Moreover, the amount that the sliding hollow rod 22 moves along the sleeves 21(A) and 21(B) is directly proportional to the linear movement of the headphone assembly within the common plane 80. Functionally, the sliding hollow rod 22 and sleeve 21(A) and 21(B) assembly (i.e., planar retention support) serves to maintain the audio set 10 on a same plane by preventing the left 205 and right 210 portions of the headband from rotating.

In essence, the linear movement of the left 205 and right 210 portions of the headband within the common plane 80 causes an inversely proportional change in the amount of bent compression force experienced by a wearer of the audio set 10. One advantage of this purely linear movement is that the angle by which the earphones 70 and 60 are in contact with the wearer's ear is largely unaffected. Accordingly, the earphones can distribute the pressure to the wearer's ear more evenly such that one portion of the earphone is not exerting more or less force than the others.

FIG. 2(B) illustrates a front, right, bottom exploded view of the behind-the-head mounted personal audio set of FIG. 1 in accordance with an embodiment of the present invention. The second end of the left 205 and right 210 portions of the headband have a greater radial thickness than that of the first end. In one embodiment, the greater radial thickness accommodates a cavity 220. The cavity 220 can be used for storage of one or more electric cables of fixed length. As shown, headband bottom cover left 230 is placed over the open cavity of the left 205 portion of headband. Headband bottom cover right 235 is placed over the open cavity of right 210 portion of headband.

As would be recognized by those of skill in the art, various other types of connector portion 50 assemblies may be used, without departing from the scope of embodiments herein. As shown in FIGS. 3(A)-3(D), embodiments may include an audio set including a headband with a rear portion that connects a left and a right side of the audio set. The rear connector portion may include different mechanisms for linear movement, which increases the distance between earphones on opposite sides of the audio set. In still other embodiments, as shown in FIGS. 3(E)-3(G), the rear connector portion includes a mechanism for expansion or contraction of the radius of curvature along the line of a curved fixed-length headband, where the mechanism produces bending of the headband for pressure adjustment. In another embodiment, the rear connector portion also holds the bend at the rear.

Figure 3A:
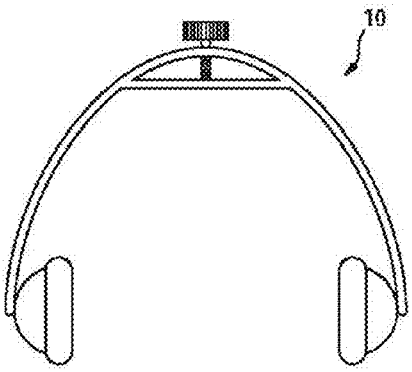
FIG. 3(A) illustrates a front view of a personal audio set with a screw clamp mechanism for adjusting force applied by earphones of the personal audio set.
Figure 3B:
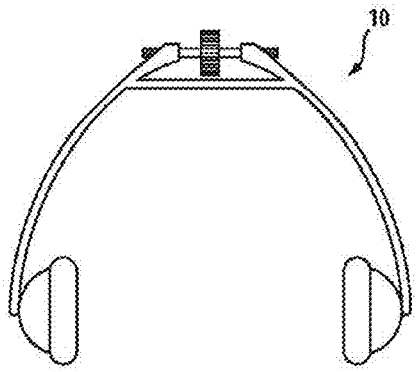
FIG. 3(B) illustrates a front view of a personal audio set with a barrel screw mechanism for adjusting force applied by earphones of the personal audio set.
Figure 3C:
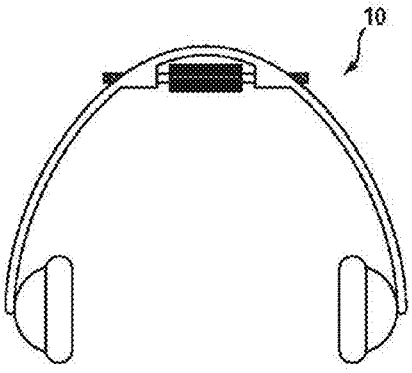
FIG. 3(C) illustrates a front view of another personal audio set with a barrel screw mechanism for adjusting force applied by earphones of the personal audio set.
Figure 3D:
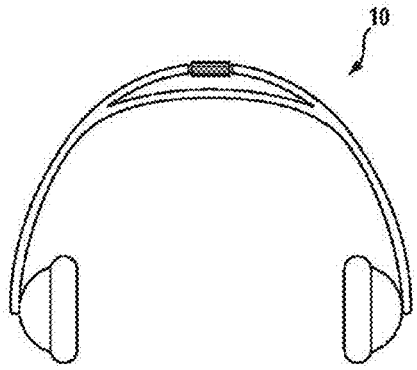
FIG. 3(D) illustrates a front view of a personal audio set with a barrel adjust mechanism for adjusting force applied by earphones of the personal audio set.
Figure 3E:
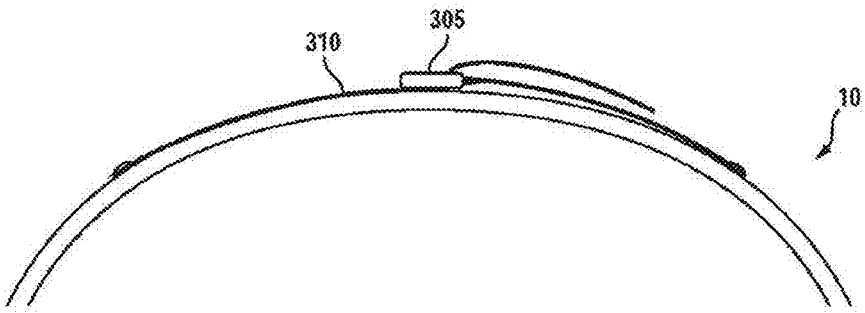
FIG. 3(E) illustrates a front view of a personal audio set with a zip strap mechanism for adjusting force applied by earphones of the personal audio set.
Figure 3F:
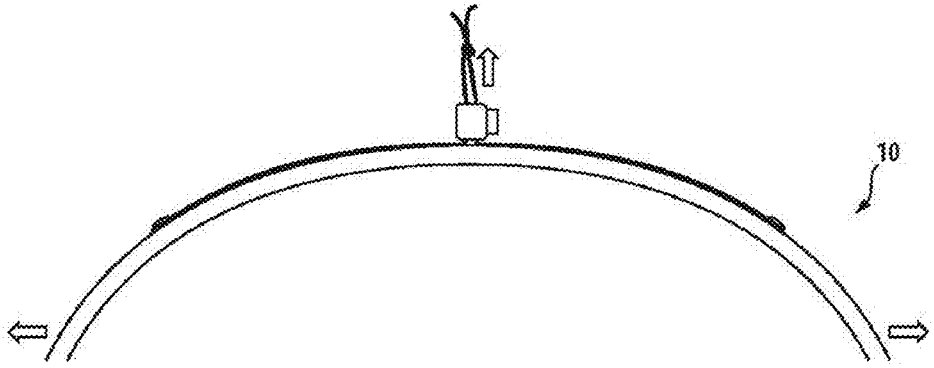
FIG. 3(F) illustrates a front view of a personal audio set with a draw string mechanism for adjusting force applied by earphones of the personal audio set.
Figure 3G:
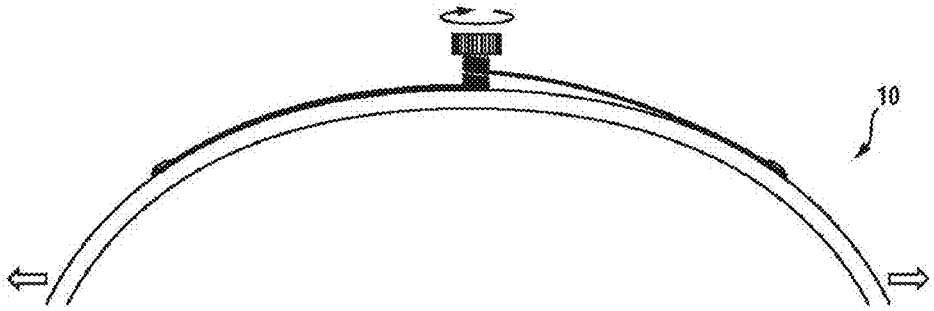
FIG. 3(G) illustrates a front view of a personal audio set with a twist adjust mechanism for adjusting force applied by earphones of the personal audio set.

FIG. 3(A) illustrates a front view of a personal audio set with a screw clamp mechanism for adjusting force applied by earphones of the personal audio set. FIG. 3(B) illustrates a front view of a personal audio set with a barrel screw mechanism for adjusting force applied by earphones of the personal audio set. FIG. 3(C) illustrates a front view of another personal audio set with a barrel screw mechanism for adjusting force applied by earphones of the personal audio set. FIG. 3(D) illustrates a front view of a personal audio set with a barrel adjust mechanism for adjusting force applied by earphones of the personal audio set. FIG. 3(E) illustrates a front view of a personal audio set with a zip strap mechanism for adjusting force applied by earphones of the personal audio set. FIG. 3(F) illustrates a front view of a personal audio set with a draw string mechanism for adjusting force applied by earphones of the personal audio set. FIG. 3(G) illustrates a front view of a personal audio set with a twist adjust mechanism for adjusting force applied by earphones of the personal audio set.

Figure 4A:
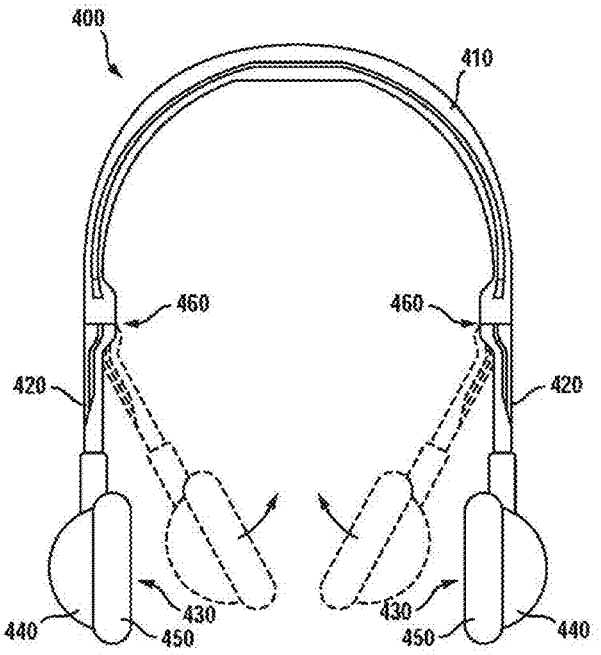
FIG. 4(A) illustrates a front, plan view of an over-the-head mounted personal audio set with pivot point adjustable force mechanism in accordance with an embodiment of the present invention.
Figure 4B:
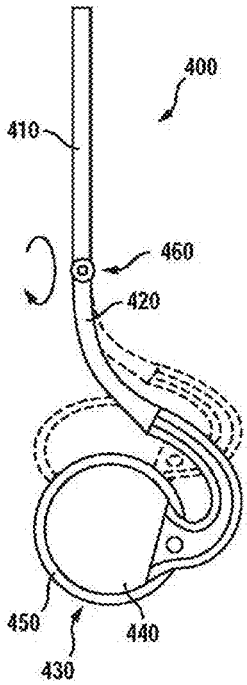
FIG. 4(B) is a side view illustrating the over-the-head mounted personal audio set with pivot point adjustable force mechanism of FIG. 4(A) in accordance with an embodiment of the present invention.

FIG. 4(A) illustrates a front, plan view of an over-the-head mounted personal audio set with pivot point adjustable force mechanism in accordance with an embodiment of the present invention. Headphone 400 has a substantially C-shaped headband 410 that can be arranged along the top of the user's head (over-the-head mount) or along the back of the user's neck (behind-the-head mount). At both ends of the headband 410 is a pair of right and left earphone units 430 which are supported by left and right pivot members 420. Each of the earphone units 430 includes a casing 440, which contains a transducer for converting an audio electric signal into sound, and an ear pad 450 covering a side portion and an ear-facing portion of the casing. The headband 410 includes two pivot points 460 located on opposite sides of the headband 410. The pivot points 460 enable the pivot members 420 and the earphone units 430 to pivot along an axis that is perpendicular to the common plane 80 of the headband 410. FIG. 4(B) is a side view illustrating the over-the-head mounted personal audio set with pivot point adjustable force mechanism of FIG. 4(A) in accordance with an embodiment of the present invention.

In one embodiment, a wearer can manually adjust the separation distance between the earphone units 430 and the wearer's ears by rotating the pivot members 420. Rotating the pivot members 420 inwards produces an increase in bent compression force applied to the wearer's ears, whereas rotating the pivot members 420 outwards causes a decrease in the force experienced by the wearer. As shown, the pivot points 460 are located on the headband 410 of an over-the-head mount such that the pivot points 460 are located near the temples of a wearer's head. Various other locations of the pivot points 460 on the headband 410 are also feasible.

The pivot points 460 may comprise a hinge joint assembly as shown in FIGS. 4(A) and 4(B). The joint assembly may limit the degree of rotational movement of the pivot members 420. The joint assembly is capable of holding the pivot members 420 to any position within the bounds of acceptable rotational movement, for example by using a locking mechanism. Thus, a user can change an angle by which the pivot members 420 meet the headband 410 by simply rotating the pivot members 420 inward or outward and the selected position is held in place by the joint assembly of the pivot points 460.

Figure 5A:
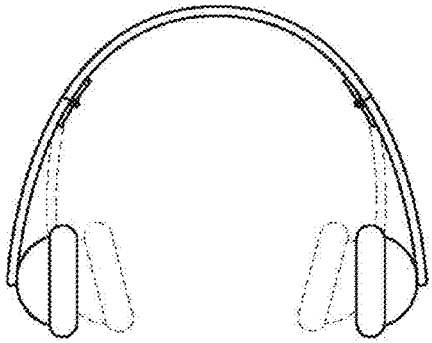
FIG. 5(A) illustrates a front view of a personal audio set with a pivot mechanism using a hinge for adjusting force applied by earphones of the personal audio set.
Figure 5B:
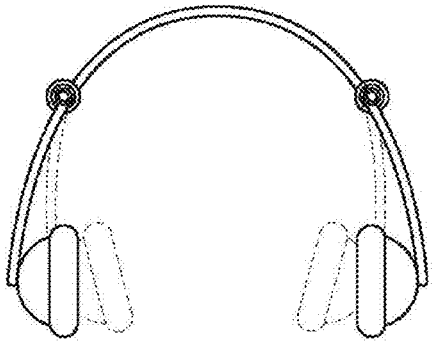
FIG. 5(B) illustrates a front view of a personal audio set with a pivot mechanism using a spring force for adjusting force applied by earphones of the personal audio set.
Figure 5C:
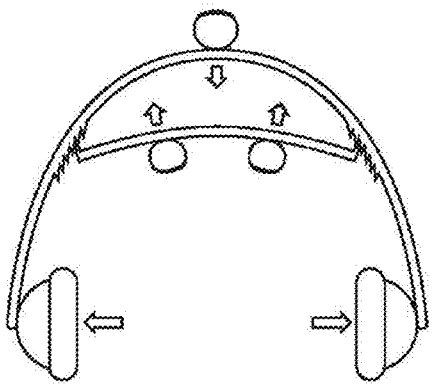
FIG. 5(C) illustrates a front view of a personal audio set with a pivot mechanism using a ratchet for adjusting force applied by earphones of the personal audio set.
Figure 5D:
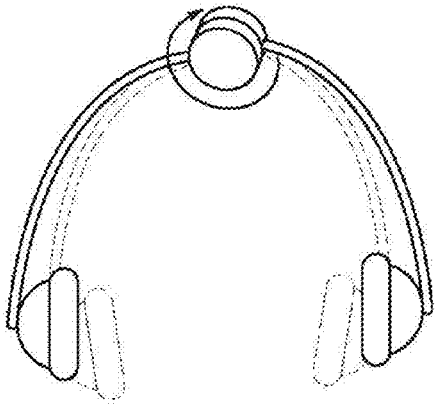
FIG. 5(D) illustrates a front, right view of a personal audio set with a single pivot mechanism for adjusting force applied by earphones of the personal audio set.
Figure 5E:
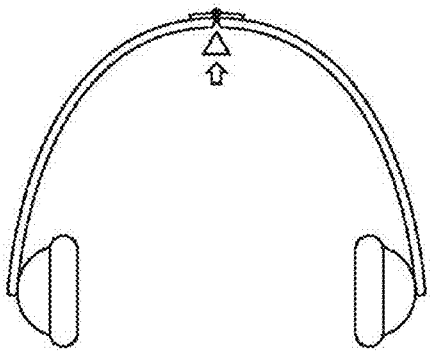
FIG. 5(E) illustrates a front view of a personal audio set with a pivot mechanism using a hinge and a drive wedge for adjusting force applied by earphones of the personal audio set.
Figure 5F:
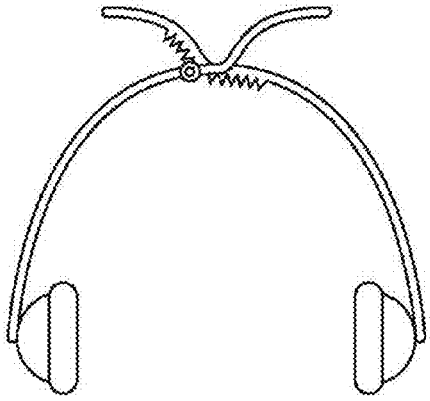
FIG. 5(F) illustrates a front view of a personal audio set with a scissor pivot mechanism for adjusting force applied by earphones of the personal audio set.
Figure 5G:
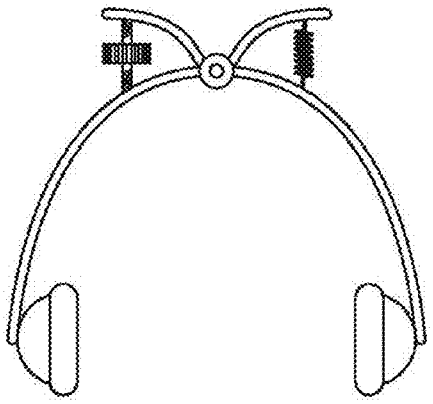
FIG. 5(G) illustrates a front view of another personal audio set with a scissor pivot mechanism for adjusting force applied by earphones of the personal audio set.
Figure 5H:
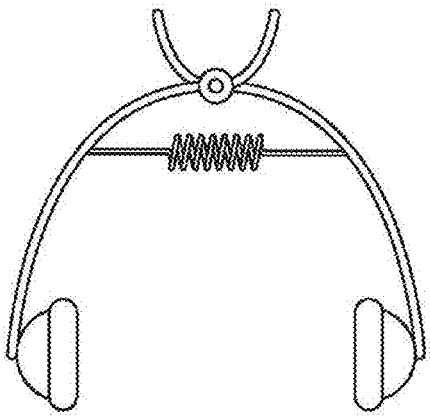
FIG. 5(H) illustrates a front view of a personal audio set with a scissor pivot mechanism using a variable spring force for adjusting force applied by earphones of the personal audio set.

Other type of joint assemblies may also be used without departing from the scope of the embodiments described herein. FIGS. 5(A)-5(H) show different variations of a pivot mechanism, including other multiple pivot points and single pivot point adjustments. FIG. 5(A) illustrates a front view of a personal audio set with a pivot mechanism using a hinge for adjusting force applied by earphones of the personal audio set. FIG. 5(B) illustrates a front view of a personal audio set with a pivot mechanism using a spring force for adjusting force applied by earphones of the personal audio set. FIG. 5(C) illustrates a front view of a personal audio set with a pivot mechanism using a ratchet for adjusting force applied by earphones of the personal audio set. FIG. 5(D) illustrates a front, right view of a personal audio set with a single pivot mechanism for adjusting force applied by earphones of the personal audio set. More specifically, the first and second portions of the headband are attached to separate rings on a cylinder. Each ring can slide around the cylinder and thereby adjust the pressure applied to a wearer's ear. FIG. 5(E) illustrates a front view of a personal audio set with a pivot mechanism using a hinge and a drive wedge for adjusting force applied by earphones of the personal audio set. FIG. 5(F) illustrates a front view of a personal audio set with a scissor pivot mechanism for adjusting force applied by earphones of the personal audio set. FIG. 5(G) illustrates a front view of another personal audio set with a scissor pivot mechanism for adjusting force applied by earphones of the personal audio set. FIG. 5(H) illustrates a front view of a personal audio set with a scissor pivot mechanism using a variable spring force for adjusting force applied by earphones of the personal audio set.

Figure 6B:
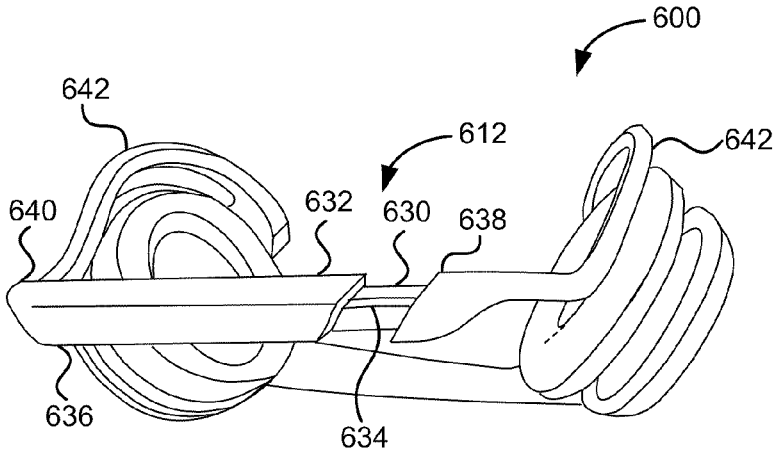
FIG. 6(B) is a perspective view of the audio set of FIG. 6(A) with the sliding mechanism partly extended.
Figure 6A:
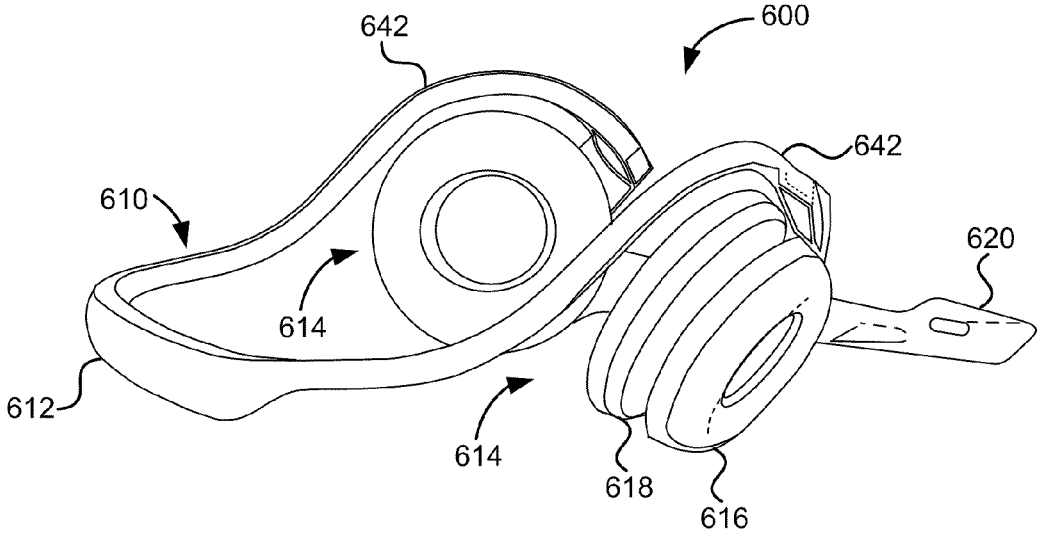
FIG. 6(A) is a perspective view of an embodiment of an audio set with a sliding mechanism.

FIGS. 6(A) and (B) illustrates an embodiment of an audio set where the connector portion has a sliding system, allowing a blade to slide out of a frame of the headband to extend its width. Users with varying head sizes can adjust the length of the sliding mechanism so that users with different head sizes still have the same compressive force on the ears. A user can place the audio set on the users head, then extend the sliding mechanism until the compressive force is comfortable, yet sufficient to hold the headset on the ears.

Headphone 600 has a headband 610 that can be arranged along the back of the user's neck with a substantially straight sliding mechanism 612. At both ends of the headband 610 is a pair of right and left earphone units 614. Each of the earphone units 614 includes a casing 616, which contains a transducer for converting an audio electric signal into sound, and an ear pad 618 covering a side portion and an ear-facing portion of the casing. A microphone boom 620 pivotably extends from one of the casings.

As best seen in FIG. (6B), sliding mechanism 612 includes a blade 630 which slides in a sleeve 632. The blade is held in the extended position by a combination of friction and detents. The detent mechanism is attached to the blade inside the sliding enclosure, which then interacts with the enclosure itself. A ridge or conduit 634 in the middle of blade 630 is hollow with a cable inside to connect to the other earphone. Blade 630 does not extend all the way into sleeve 632, leaving a hollow portion at an end 636 of sleeve 632, into which the cable can bend or coil as the blade is pushed into the sleeve. Blade 630 is made of metal, while sleeve 632, and arms 642, are made of a plastic, such as polycarbonate or polypropylene.

Sliding mechanism 612 is substantially straight, so that the force on the ears does not significantly vary as it is widened for larger head sizes. Yet there is a small curvature to conform to the back of the typical person's neck to make it more comfortable. A slight curve is provided along the sliding mechanism, as measured from opening 638 to a corresponding seam 640 on the other end. The radius of the curve varies between about 223 mm in the closed position to 193 mm in the open position. In one embodiment, the radius of the curve is at least 140 mm to insure minimal variation in force and appropriate comfort on the back of the neck.

Sliding mechanism 612 is wider than arms 642, which extend along the side of the head, and then loop over the ears, between the head and earlobes. The earlobe is thus between an arm 642 and ear pad 618. The extra width of sliding mechanism 612, including the width of blade 642, provides extra strength and stability when the sliding mechanism is in an extended position. In one embodiment, the blade is about 9 mm wide, and is at least 7 mm wide in other embodiments. The widened portion of the sleeve is about 75 mm in one embodiment, and at least 60 mm and no more than 90 mm in other embodiments. The blade extends out 30 mm in one embodiment, and at least 20 mm and no more than 50 mm in other embodiments.

Although the present invention has been described in detail with regarding the exemplary embodiments and drawings thereof, it should be apparent to those skilled in the art that various adaptations and modifications of the present invention may be accomplished without departing from the spirit and the scope of the invention. Thus, by way of example and not of limitation, the present invention is discussed with regard to over-the-head mounts and back-of-the-head mounts as illustrated by the figures. However, the methods may be implemented for various types of audio sets, unless specified otherwise. For example, although the audio set has been described as being formed in an arc, other embodiments of audio sets may be used. The audio set may be formed in many shapes. In other embodiments, the audio set is comprised of multiple arcs. Furthermore, multiple pivot points may be used to adjust pressure, including, for example, a pivot point at a rear portion of a headband and two pivots at opposite side portions of the headband. Accordingly, the invention is not limited to the precise embodiment displayed in the drawings and described in detail herein above. The scope of the invention should, therefore, be determined not with reference to the above description, but instead should be determined with reference to the pending claims along with their full scope or equivalents.

What is claimed is:

1. A personal audio device comprising:

a flexible headband comprising a left headband portion and a right headband portion, the headband having a longitudinal centerline and occupying a substantially single plane;

a left earphone secured to a first end of the left headband portion;

a right earphone secured to a first end of the right headband portion;

a connector portion connecting the second end of the left headband portion with a second end of the right headband portion, the connector portion being linearly adjustable enabling a distance between the left headband portion and right headband portion to be variable, wherein a change in the distance causes an inversely proportional change in bent compression force applied by the left earphone and applied by the right earphone.

2. The personal audio device of claim 1, wherein the connector portion occupies the same substantially single plane occupied by the headband.

3. The personal audio device of claim 1, wherein the change in the distance between the left headband portion and the right headband portion does not affect a user contact angle of the left earphone and a user contact angle of the right earphone.

4. The personal audio device of claim 1, further comprising: a planar retention support connecting the left headband portion with the right headband portion, and keeping the headband within the substantially single plane during linear adjustment of the connector portion.

5. The personal audio device of claim 1, wherein the connector portion comprises a screw clamp mechanism.

6. The personal audio device of claim 1, wherein the connector portion comprises a barrel screw mechanism.

7. The personal audio device of claim 1, wherein the connector portion comprises a barrel wheel adjustment mechanism.

8. The personal audio device of claim 1, wherein the connector portion comprises a buckle strap mechanism.

9. The personal audio device of claim 1, wherein the connector portion comprises a twist adjustment mechanism.

10. The personal audio device of claim 1, wherein the connector portion comprises a draw string mechanism.

11. A personal audio device comprising:

a flexible headband having a pair of ends;

a first pivot mechanism to pivotally attach a first earphone assembly to one end of said headband for pivoted motion between an initial operating position and one or more adjustable operating positions; and a second pivot mechanism to pivotally attach a second earphone assembly to the other end of said headband for pivotal motion between the initial operating position and the one or more adjustable operating positions, wherein pivoting at least one of the first earphone and the second earphone causes an change in bent compression force applied by the pivoted one of the first earphone and the second earphone.

12. The personal audio device of claim 11 further comprising:

a lock on each end of the headband to releasably retain each earphone in each of the initial operating positions and the one or more adjustable operating positions.

13. The personal audio device of claim 11, wherein the first pivot mechanism comprises a first pivot point attaching the first earphone to the one end of the headband and the second pivot mechanism comprises a second pivot point attaching the second earphone to the other end of the headband.

14. The personal audio device of claim 11, wherein the first pivot mechanism and the second pivot mechanism each comprises a spring.

15. The personal audio device of claim 11, wherein a location of the first pivot mechanism and a location of the second pivot mechanism are each proximate to a temple of a user when in the initial operating position or the one or more adjustable operating positions.

16. A personal audio device comprising:

a flexible headband comprising a left headband portion and a right headband portion;

a left earphone secured to a first end of the left headband portion;

a right earphone secured to a first end of the right headband portion;

a pivot mechanism connecting the second end of the left headband portion with a second end of the right headband portion, the pivot mechanism enabling pivoted motion of at least one of the left headband portion and the right headband portion between an initial operating position and one or more adjustable operating positions, wherein pivoting at least one of the left headband portion and the right headband portion causes a change in bent compression force applied by the pivoted one of the left headband portion and the right headband portion.

17. The personal audio device of claim 16, wherein the pivot mechanism comprises a drive wedge mechanism.

18. The personal audio device of claim 16, wherein the pivot mechanism comprises a ratchet and a pinion mechanism.

19. The personal audio device of claim 16, wherein the pivot mechanism comprises a variable spring force mechanism.

20. The personal audio device of claim 16, wherein the pivot mechanism comprises a scissor adjustment mechanism.

21. A personal audio device comprising:

a flexible headband of fixed length comprising a left headband portion and a right headband portion, the headband having a longitudinal centerline and occupying a substantially single plane;

a left earphone secured to a first end of the left headband portion;

a right earphone secured to a first end of the right headband portion;

a connector portion connecting the second end of the left headband portion with a second end of the right headband portion, the connector portion being adjustable enabling a distance between the left headband portion and right headband portion to be variable, wherein a change in the distance causes an inversely proportional change in bent compression force applied by a left earphone and applied by the right earphone.

22. A personal audio device comprising:

a flexible headband comprising a left headband portion and a right headband portion;

a left earphone secured to a first end of the left headband portion;

a right earphone secured to a first end of the right headband portion;

a connector portion connecting the second end of the left headband portion with a second end of the right headband portion, the connector portion having a single sliding mechanism that is substantially linearly adjustable enabling a distance between the left headband portion and right headband portion to be variable, said sliding mechanism, in an extended position, have a curvature corresponding to a circle with a radius of at least 40 mm.

23. The personal audio device of claim 22 wherein said sliding mechanism comprises:

a blade extending from a first one of said headband portions;

a sleeve extending from a second one of said headband portions, said sleeve being configured to enclose said blade, said sleeve being sufficiently tight around said blade to allow said blade to extend and yet to hold said blade in an extended position.

24. The personal audio set of claim 23 further comprising:

a conduit in said blade;

a cable extending through said conduit in said blade;

a gap in an end of said sleeve opposite said blade, said gap being sufficiently sized to accommodate bends in said cable when said blade is fully inserted into said sleeve.

25. A personal audio device comprising:

a flexible headband comprising a left headband portion and a right headband portion;

a left earphone secured to a first end of the left headband portion;

a right earphone secured to a first end of the right headband portion;

a connector portion connecting the second end of the left headband portion with a second end of the right headband portion, the connector portion having a single sliding mechanism that is substantially linearly adjustable enabling a distance between the left headband portion and right headband portion to be variable, said sliding mechanism, in an extended position, have a curvature corresponding to a circle with a radius of at least 40 mm;

wherein said sliding mechanism comprises:

a blade extending from a first one of said headband portions;

a sleeve extending from a second one of said headband portions, said sleeve being configured to enclose said blade, said sleeve being sufficiently tight around said blade to allow said blade to extend and yet to hold said blade in an extended position a conduit in said blade;

a cable extending through said conduit in said blade;

a gap in an end of said sleeve opposite said blade, said gap being sufficiently sized to accommodate bends in said cable when said blade is fully inserted into said sleeve;

wherein said blade has a width of at least 7 mm.

26. The personal audio device of claim 1, wherein the flexible headband is sized to encircle the rear contour of a wearer's head.

27. The personal audio device of claim 21, wherein the flexible headband of fixed length is curved and wherein the connector portion includes a mechanism for expansion or contraction of the radius of curvature along the line of the curved fixed length headband.

28. The personal audio set of claim 27, wherein the mechanism produces bending of the headband for pressure adjustment.

29. The personal audio set of claim 11, wherein at least one of the first pivot mechanism and the second pivot mechanism is configured to be pivoted by a user by rotating the at least one of the first pivot mechanism or the second pivot mechanism inward or outward to a selected position.

30. The personal audio set of claim 29 wherein the selected position is held into place by a joint assembly of the pivot mechanism.

31. The personal audio set of claim 22 wherein the personal audio device is configured to be arranged along the back of the user's neck.

* * * * *

UNITED STATES PATENT AND TRADEMARK OFFICE

CERTIFICATE OF CORRECTION

PATENT NO. : 8,170,261 B2
APPLICATION NO. : 12/436733
DATED : May 1, 2012
INVENTOR(S) : Danielson et al.

It is certified that error appears in the above-identified patent and that said Letters Patent is hereby corrected as shown below:

In claim 11, column 10, line 56, after “causes”, replace “an” with --a--

In claim 22, column 11, line 66, replace “have” with --having--

In claim 25, column 12, line 29, replace “have” with --having--

In claim 25, column 12, line 38, after “position”, insert --;--

In claim 30, column 12, line 62, after “claim 29”, insert --,--

In claim 31, column 12, line 65, after “claim 22”, insert --,--

Signed and Sealed this
Fourteenth Day of August, 2012

David J. Kappos

David J. Kappos
*Director of the United States Patent and Trademark Office*